United States Patent [19]

Mock

[11] 4,238,982

[45] Dec. 16, 1980

[54] PROGRAMMABLE PERFORATOR HEAD

[76] Inventor: Vernon A. Mock, 2250 Linneman, Glenview, Ill. 60025

[21] Appl. No.: 57,210

[22] Filed: Jul. 13, 1979

[51] Int. Cl.[3] ..... G26F 1/20

[52] U.S. Cl. ..... 83/332; 83/433; 83/482; 83/564; 83/678

[58] Field of Search ..... 83/304, 305, 332, 433, 83/482, 564, 678

[56] References Cited

U.S. PATENT DOCUMENTS

| | | | |
|---|---|---|---|
| 995,868 | 6/1911 | Housam | 83/305 |
| 3,347,123 | 10/1967 | Worner et al. | 83/564 X |
| 3,518,907 | 7/1970 | Pinel | 83/564 X |

*Primary Examiner*—J. M. Meister

*Attorney, Agent, or Firm*—Rummler & Snow

[57] ABSTRACT

A sheet perforator head having a perforating wheel rotationally supported on a solenoid-operated, toggle-actuated leverage arm and capable of perforating according to program.

3 Claims, 3 Drawing Figures

PROGRAMMABLE PERFORATOR HEAD

BACKGROUND OF THE INVENTION

This perforator head is used in combination with the sheet feed table programming means such as that disclosed in my co-pending patent application on PROGRAMMABLE PRESSURE-SENSITIVE TRANSFER TAPE APPLICATOR, Ser. No. 57,209, filed July 13, 1979.

SUMMARY OF THE INVENTION

The gist of this invention lies in a sheet perforating head having a leveraged arm for applying a perforator wheel to moving sheet which is actuated by a solenoid-operated toggle mechanism according to program.

THE PREFERRED EMBODIMENT

Figure 1:
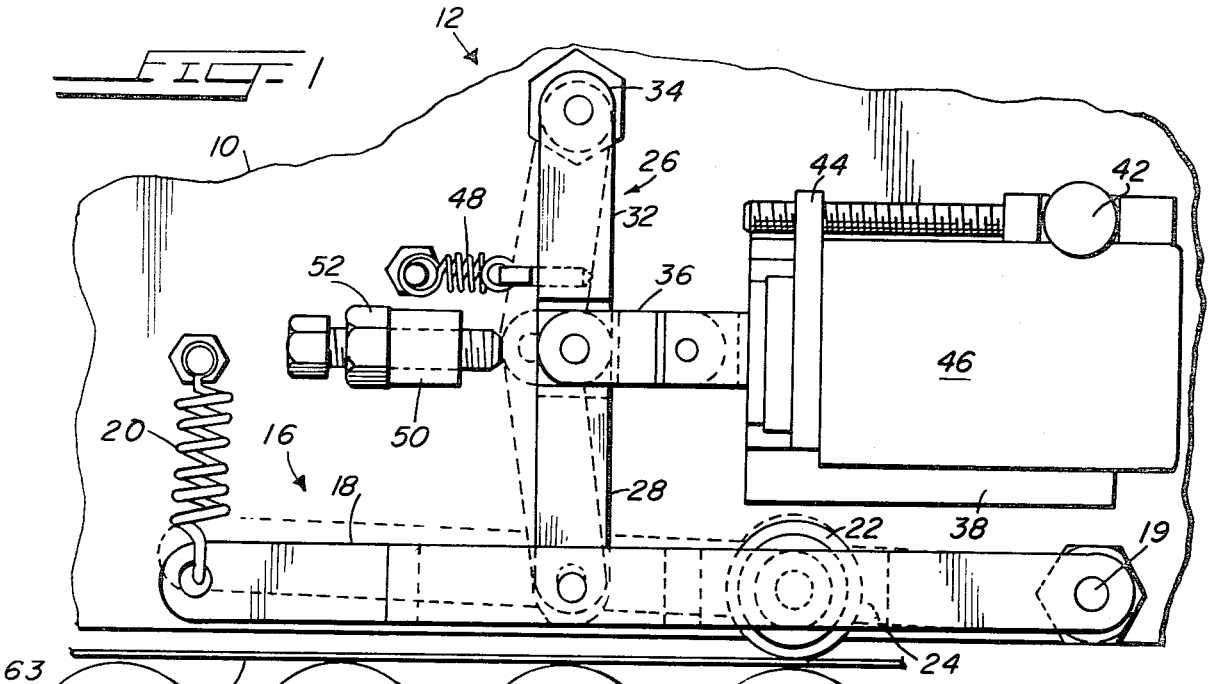
FIG. 1 shows a fragmentary side view of the sheet perforator head of this invention.

Reference to FIG. 1 shows a frame 10 for a sheet perforating head 12 which typically mounts on crossbars (not shown) extending from side-supporting pedestals (not shown) of a table for feeding sheet material 14 to be perforated according to a program on a horizontal feed roller assembly 22.

Figure 2:
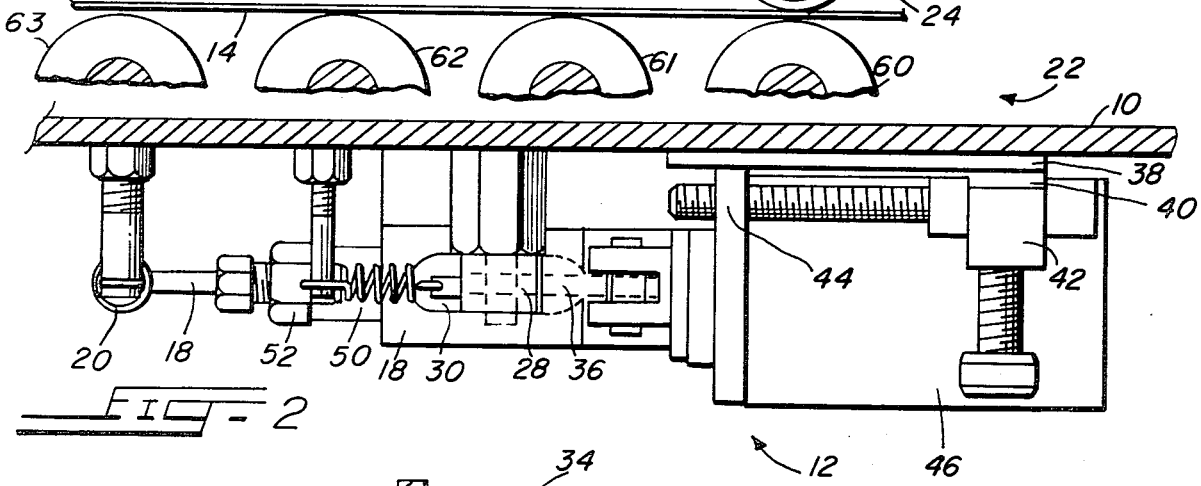
FIG. 2 shows a fragmentary top view of the same.
Figure 3:
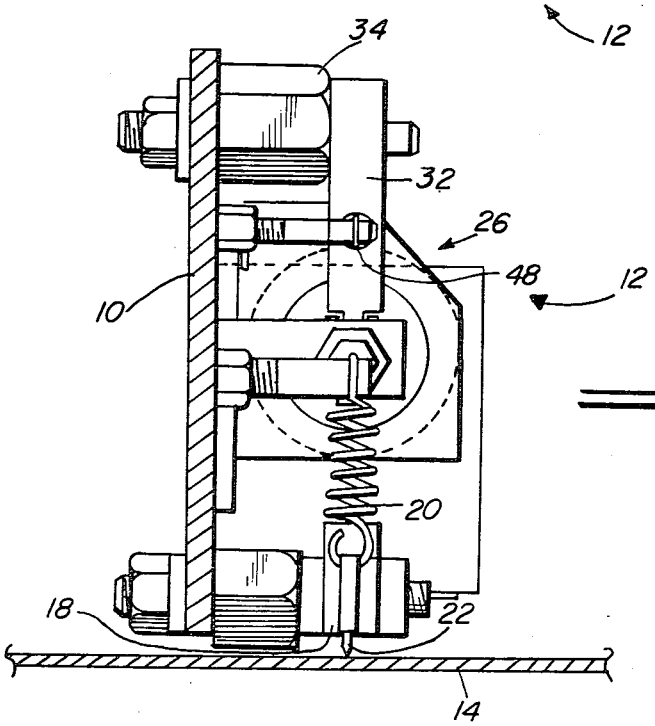
FIG. 3 shows a fragmentary left hand end view of the same.

The perforator head 12 comprises a perforating wheel actuator 16 having an arm 18 wherein one end pivotally mounts to the frame 10 in anchor pivot 19. Pivot 19 has its axis parallel to the axes of feed roller assembly 22 and locates between and in a first horizontal plane which is parallel to and spaced above the plane containing the axes of rollers 60 and 61 of feed roller assembly 22. A vertical plane extends along the length of arm 18 bisecting the perforator head 12. The actuating arm 18 extends from the pivot 19 at one end along the junction of first horizontal and vertical planes and in the direction of feed of sheet 14. Arm 18 stands in spaced relation above the plane containing the axes of rollers 60, 61, 62 and 63, respectively, as shown in FIG. 1. A first tension spring 20 operationally connects one of its ends to frame 10 above the other end of arm 18 and its other end to the other end of the arm 18 at a position adjacent to and above roller 63. A perforating wheel 22 rotationally mounts in a first elongated slot 24 in actuating arm 18 in the vertical plane with its axis in parallel relation to the axis of pivot 19. Slot 24 is perpendicular to said first horizontal plane and extends along the length of arm 18 about one-third the distance therefrom, as shown in FIGS. 1 and 2.

A toggle assembly 26 mounts above the actuation arm 18 on frame 10 in the vertical plane of the perforating wheel 22 in position for toggling in a second horizontal plane which is parallel to the first and located a little over halfway along the length of the same from the pivot 19. Toggle 26 comprises a lower toggle link 28 which extends upward in the vertical plane slanting slightly toward the direction of sheet feed from a lower end which is pivoted in a second elongated slot 30 in arm 18 about an axis parallel to the axis of pivot 19. Second elongated slot 30 extends along the length of arm 18 about a position located at a little over half its length from its pivoted end perpendicular to the first plane therethrough, as shown in FIGS. 1 and 2. An upper toggle link 32 having approximately the same length as lower toggle link 28 extends slantingly upward in a reverse direction against the direction of sheet feed and pivotally joints its lower end to the upper end of lower toggle link 28 also about an axis parallel to the axis of pivot 19. The upper end of upper toggle link 32 is pinned to a vertically-adjustable eccentric pivot anchor 34 which mounts on the frame 10 in the vertical plane directly above the pivoted lower end of lower toggle link 28 on actuating arm 18.

A drive link member 36 pivotally mounts in the second horizontal plane at one end on the same pivot axis as that of the pivotally-joined lower end of upper toggle link 32 and upper end of lower toggle link 28 and extends in the direction against sheet feed therefrom. A solenoid carrier 38 having dovetail ways straddles in spaced relation above and below the second horizontal plane on the frame 10. An adjustable solenoid carriage 40 slidingly mounts in carrier 38 having a locking device 42 operationally connected thereon with thumbscrew 44 for positioning the carriage 40 with respect thereto. A single-acting solenoid 46 mounts on carriage 40 with its armature coincident with the axis of link 36 and pivotally-pining to the other end of the same. A second tension spring 48 operationally connects one end to frame 10 and its other end to the lower portion of the upper toggle link 32 with its line of action in the direction of sheet feed. A stop screw 50 having a jambnut 52 mounts on the frame 10 in the vertical plane and in line with the horizontal axis of link 36.

In a typical operation, the sheet perforating head 12 mounts on crossbars extending from side-supporting pedestals of a table having a horizontal sheet feed roller assembly 22 comprising perforation roller 60, idler roller 61, application roller 62 and pressure roller 63, which are rotationally mounted in the top of the table and driven by a drive train (not shown) which is powered by a prime mover (not shown). Sheet guide rails (not shown) mount on top of the table and a sheet edge sensor (not shown) mounts on the table above the sheet feed roller assembly between the guide rails. The sheet leading and trailing edge sensor comprises an optoelectronic device having a light-emitting diode (not shown) and a modulated photoelectric cell (not shown) which reflectively receives the light therefrom due to the presence of sheet 14 on the table.

The program of instructions for perforating the sheet 14 is stored in memory on the cylindrical surface of a drum (not shown) as sections of optically black pressure-sensitive indexing tape which is selectively applied in a circumferential direction to the reflective surface of the drum. Access to these stored instructions for applying the perforator head 12 to moving sheet 14 according to the program is serially read out from the drum by rotating the drum one complete rotation or less under exposure of the light from optoelectronic sensor and sensing the presence or absence of the indexing tape thereon by the reflection therefrom. When the sheet edge sensor indicates that no sheet is on the table, a torsion spring on the axis of the drum returns it to its initial position.

The optoelectronic sensor comprises a light-emitting diode (not shown) and corresponding photoelectric cell (not shown) which focuses on the reflectivity of the optically-black tape on the drum. The drum drive operationally connects to the sheet feed drive train which is coupled to be driven through an electro-magnetic clutch which is electrically interconnected with the sheet edge sensor such that unless sheet 14 is present on the table, the perforator head 12 will not perforate.

Although but one specific embodiment of this invention is herein shown and described, it will be understood that details of the construction shown may be altered or omitted without departing from the spirit of the invention as defined by the following claims.

I claim:

1. A sheet perforator head comprising:

(a) a frame adapted to be mounted above a sheet feed table;

(b) a horizontally-disposed arm pivoted at one end to the frame about an axis perpendicularly disposed to the direction of feed on the sheet feed table;

(c) a return spring operationally connected to the other end of said arm and adapted to lift the arm from the sheet on the feed table;

(d) a perforating wheel rotationally mounted in a leveraged position on said arm and having its axis of rotation above and perpendicularly disposed to the direction of feed on the sheet feed table; and (e) a toggle actuating means mounted on the frame above the arm and operationally connected in leveraged position between a pivot pin on said arm and a pivot means on said frame arranged in perpendicular relation to the direction of feed on the sheet feed table.

2. A perforator head as set forth in claim 1 wherein the toggle actuating means comprises:

(a) upper and lower links pin-joined at one end in common and pivotally connecting at their upper end to the frame and at their lower end to the horizontal arm means;

(b) a horizontally-disposed connecting drive link having one end pin-ended to the pin joint of said upper and lower links; and (c) a solenoid mounted on said frame having its armature pin-connected to the other end of the connecting drive link.

3. A perforator head having a frame for mounting on crossbars extending from side-supporting pedestals on a table of feed rollers for feeding sheet material to be perforated according to a programming means comprising an actuating arm pivotally mounting one end to the frame and having its axis parallel to and above the plane of the feed rollers and located therebetween; a first tension spring operationally connecting one of its ends to said arm and the other to said frame above the same at a position adjacent to and above one of the rollers; a perforating wheel rotationally mounting in a first elongated slot in the actuating arm in the vertical plane with its axis in parallel relation to the pivot axis of the arm; a lower toggle link extending slantingly upward toward the direction of sheet feed from a lower end pivotally mounting in a second elongated slot in the arm; an upper toggle link having approximately the same length as the lower toggle link extending slantingly upward in a reverse direction against the direction of sheet feed from a pivotally joined lower end of said upper toggle link with the upper end of said lower toggle link and having its upper end pinned to a vertically adjustable pivot anchor mounting on the frame; a drive link pivotally mounting at one end on the pivot axis of the pivotally joined lower end of the upper toggle link and the upper end of the lower toggle link and extending in the direction against sheet feed; a solenoid carrier having dovetail ways mounting on the frame and straddling the drive link; an adjustable solenoid carriage slidingly mounting in the ways of the carrier having a locking device operationally connected thereon with a thumbscrew for positioning the carriage with respect thereto; a single-acting solenoid mounting on the carriage having its armature pin-connected with the other end of the drive link; a second tension spring operationally connecting one end to the frame and its other end to the lower portion of the top toggle link with its line of action in the direction of sheet feed; and an adjustable stop screw having a locking jambnut mounting on the frame having its line of action against the thrust of the solenoid in breaking of the toggle.

* * * * *